US012557876B2

(12) United States Patent
Bowman et al.

(10) Patent No.: US 12,557,876 B2
(45) Date of Patent: Feb. 24, 2026

(54) SOLE STRUCTURE FOR ARTICLE OF FOOTWEAR AND ARTICLE OF FOOTWEAR

(71) Applicant: NIKE, Inc., Beaverton, OR (US)

(72) Inventors: Matthew Bowman, Tigard, OR (US); Lee Gibson, Portland, OR (US); Joël Ryp Greenspan, Portland, OR (US); Dylan Petrenka, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 182 days.

(21) Appl. No.: 18/191,099

(22) Filed: Mar. 28, 2023

(65) Prior Publication Data

US 2023/0225454 A1 Jul. 20, 2023

Related U.S. Application Data

(63) Continuation of application No. 16/935,509, filed on Jul. 22, 2020, now Pat. No. 11,633,010.

(51) Int. Cl.

| | |
|---|---|
| ***A43B 13/18*** | (2006.01) |
| ***A43B 13/12*** | (2006.01) |
| ***A43B 13/14*** | (2006.01) |

(52) U.S. Cl.

CPC ..... *A43B 13/189* (2013.01); *A43B 13/141* (2013.01); *A43B 13/122* (2013.01)

(58) Field of Classification Search

CPC ..... A43B 7/141; A43B 3/0063; A43B 13/023; A43B 13/125

See application file for complete search history.

(56) References Cited

U.S. PATENT DOCUMENTS

| | | | | |
|---|---|---|---|---|
| 2,857,689 | A * | 10/1958 | Van Ostrom | A43B 7/142 D25/138 |
| 4,360,027 | A * | 11/1982 | Friedlander | A43B 7/14 36/80 |
| 5,224,277 | A * | 7/1993 | Sang Do | A43B 7/082 36/3 R |
| 5,713,141 | A | 2/1998 | Mitchell et al. | |
| 5,771,606 | A | 6/1998 | Litchfield | |
| 5,952,065 | A | 9/1999 | Mitchell et al. | |

(Continued)

FOREIGN PATENT DOCUMENTS

| | | | |
|---|---|---|---|
| EP | 0958752 | A1 | 11/1999 |
| WO | WO-2021119070 | A1 | 6/2021 |

OTHER PUBLICATIONS

European Patent Office, Extended European Search Report for EP App. No. 24210014.7, mailed Jan. 14, 2025.

(Continued)

*Primary Examiner* — Alissa L Hoey
*Assistant Examiner* — Akwokwo Olabisi Redhead
(74) *Attorney, Agent, or Firm* — Honigman LLP; Matthew H. Szalach; Jonathan P. O'Brien

(57) ABSTRACT

A sole structure for an article of footwear includes an outsole defining a ground-contacting surface, a midsole disposed between the outsole and the upper, and a plate attached to the midsole and defining a recess extending in a direction away from the outsole and toward the upper, the recess including a first retainer. The sole structure further includes a first cushion having a first portion received within the recess, the first portion engaging the first retainer to maintain a desired position of the first cushion relative to the plate.

18 Claims, 10 Drawing Sheets

(56) References Cited

U.S. PATENT DOCUMENTS

| | | | | |
|---|---|---|---|---|
| 6,582,786 | B1 | 6/2003 | Bonk et al. | |
| 7,793,432 | B2 | 9/2010 | Chan et al. | |
| 9,554,621 | B2 | 1/2017 | Truelsen | |
| 10,448,704 | B2 | 10/2019 | Dupre et al. | |
| 10,842,224 | B2 | 11/2020 | Farina et al. | |
| 2004/0128860 | A1 | 7/2004 | Smaldone et al. | |
| 2009/0094856 | A1 | 4/2009 | Guerra | |
| 2009/0100705 | A1 | 4/2009 | Cook et al. | |
| 2011/0277346 | A1 | 11/2011 | Peyton | |
| 2012/0246971 | A1 | 10/2012 | Donzis | |
| 2014/0082969 | A1 | 3/2014 | Binzer | |
| 2014/0259758 | A1* | 9/2014 | Yeh | A43B 17/006 36/44 |
| 2015/0223564 | A1 | 8/2015 | Peyton | |
| 2016/0120263 | A1 | 5/2016 | Cortez | |
| 2016/0242499 | A1* | 8/2016 | Droege | A43B 13/42 |
| 2018/0213886 | A1* | 8/2018 | Connell | A43B 13/184 |
| 2019/0251578 | A1 | 8/2019 | Blanchet | |
| 2020/0205514 | A1* | 7/2020 | VanDomelen | A43B 13/188 |
| 2021/0000133 | A1 | 1/2021 | Meldrum | |
| 2021/0068419 | A1 | 3/2021 | Spirk | |
| 2021/0169170 | A1* | 6/2021 | Fahmi | A43B 13/125 |
| 2021/0221596 | A1 | 7/2021 | Broussin | |
| 2023/0232939 | A1* | 7/2023 | Siegismund | A43B 13/184 36/25 R |

OTHER PUBLICATIONS

European Patent Office (ISA), International Search Report and Written Opinion for PCT App. No. PCT/US2021/042595, mailed Nov. 12, 2021.

USPTO, Final Office Action for U.S. Appl. No. 16/935,509, mailed Apr. 4, 2022.

USPTO, Non-Final Office Action for U.S. Appl. No. 16/935,509, mailed Oct. 14, 2021.

* cited by examiner

SOLE STRUCTURE FOR ARTICLE OF FOOTWEAR AND ARTICLE OF FOOTWEAR

CROSS REFERENCE TO RELATED APPLICATION

This application is a continuation of U.S. patent application Ser. No. 16/935,509, filed Jul. 22, 2020. The disclosure of this prior application is considered part of the disclosure of this application as is hereby incorporated by reference in its entirety.

FIELD

The present disclosure relates to an article of footwear and more particularly to a sole structure for an article of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhances traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

In addition to the foregoing elements, sole structures are increasingly incorporating plates that provide the sole structures with increased support and stability during use. Such plates may be disposed at discrete regions of the sole structure to provide localized areas of increased stiffness and support or, alternatively, can be so-called full-length plates that extend continuously between an anterior end of the sole structure and a posterior end of the sole structure and between a medial side of the sole structure and a lateral side of the sole structure.

While incorporating plates into a sole structure of an article of footwear provides the sole structure and, thus, the article of footwear, with increased support and stability, such plates may increase the stiffness of the sole structure to a point where bending of the sole structure becomes difficult. Further, such plates are often not designed to accommodate other cushions such as, for example, foam blocks or fluid-filled chambers.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
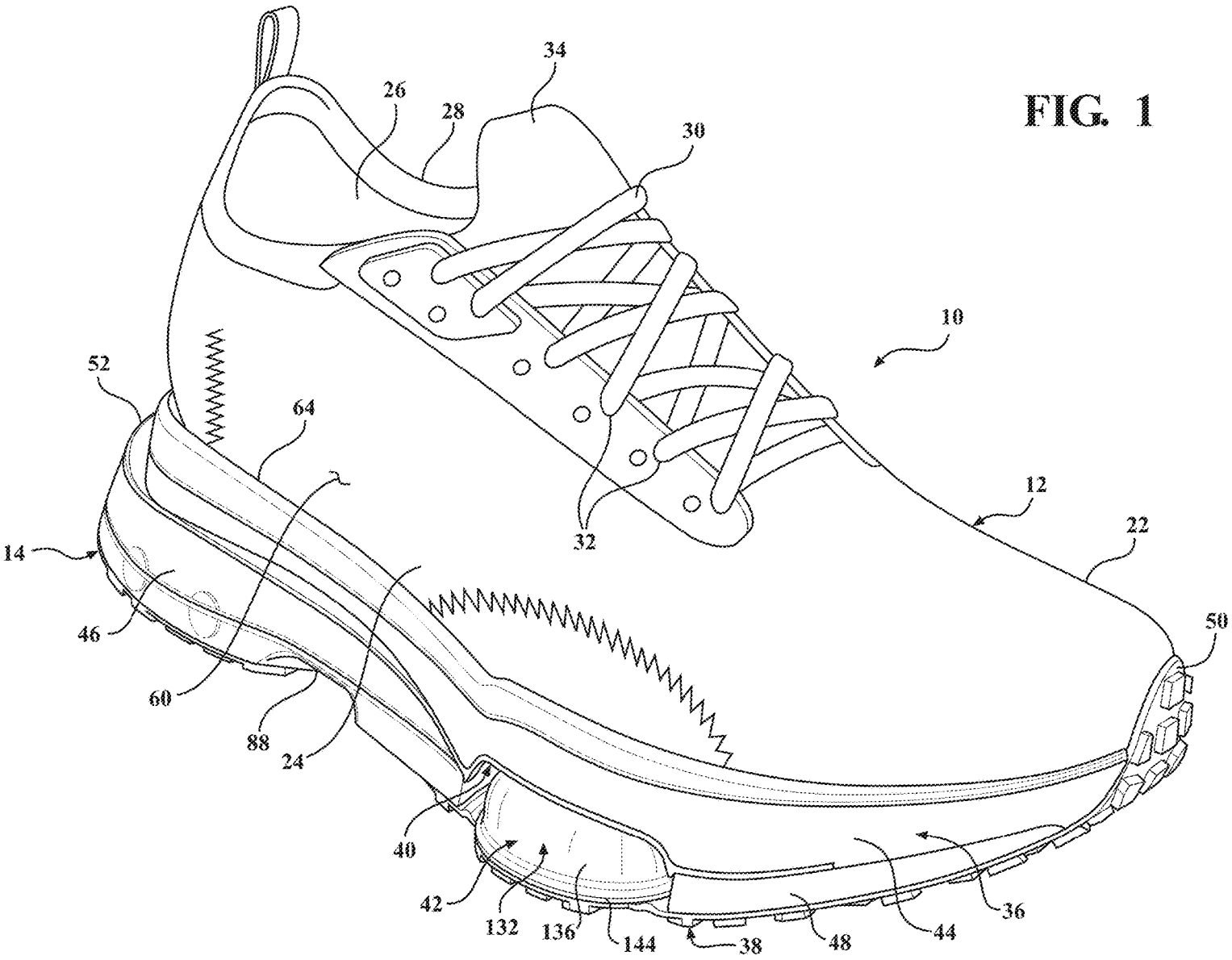
FIG. 1 is a perspective view of an article of footwear in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear having an upper is provided. The sole structure includes an outsole defining a ground-contacting surface, a midsole disposed between the outsole and the upper, and a plate attached to the midsole and defining a recess extending in a direction away from the outsole and toward the upper, the recess including a first retainer. The sole structure further includes a first cushion having a first portion received within the recess, the first portion engaging the first retainer to maintain a desired position of the first cushion relative to the plate.

The sole structure may include one or more of the following optional features. For example, the first cushion may include a second portion extending from the recess in a direction toward the outsole. Additionally or alternatively, the recess may extend from a medial side of the sole structure to a lateral side of the sole structure. Further, the first retainer may be disposed closer to one of the medial side and the lateral side than the other of the medial side and the lateral side.

In one configuration, a second retainer may be disposed within the recess. The first retainer may be disposed adjacent to one of a medial side of the sole structure and a lateral side of the sole structure and the second retainer may be disposed adjacent to the other of the medial side and the lateral side. The first retainer and the second retainer may be aligned with one another across a width of the sole structure. A second cushion may include a first portion received within the recess, whereby the first portion of the second cushion engages the second retainer to maintain a desired position of the second cushion relative to the plate. At least one of the first cushion and the second cushion may be a fluid-filled chamber.

The first retainer may be a flange integrally formed with the plate and may extend from a surface of the plate within the recess in a direction toward the outsole.

In another configuration, a sole structure for an article of footwear having an upper is provided. The sole structure may include an outsole defining a ground-contacting surface, a midsole disposed between the outsole and the upper, and a plate attached to the midsole and including a first retainer, the first retainer extending from a first surface of the plate in a direction toward the outsole. The sole structure further includes a first cushion opposing the first surface of the plate and engaging the first retainer to maintain a desired position of the first cushion relative to the plate.

The sole structure may include one or more of the following optional features. For example, the plate may include a main surface. The first surface may be offset from the main surface in a direction toward the upper to define a recess. The recess may extend from a medial side of the sole structure to a lateral side of the sole structure. Additionally, the first retainer may be disposed closer to one of the medial side and the lateral side than the other of the medial side and the lateral side.

A second retainer may extend from the first surface of the plate in a direction toward the outsole. The first retainer may be disposed adjacent to one of a medial side of the sole structure and a lateral side of the sole structure and the second retainer may be disposed adjacent to the other of the medial side and the lateral side. The first retainer and the second retainer may be aligned with one another across a width of the sole structure. A second cushion may oppose the first surface of the plate and may engage the second retainer to maintain a desired position of the second cushion relative to the plate. At least one of the first cushion and the second cushion may be a fluid-filled chamber.

The first retainer may be a flange integrally formed with the plate.

The details of one or more implementations of the disclosure are set forth in the accompanying drawings and the description below. Other aspects, features, and advantages will be apparent from the description and drawings, and from the claims.

With reference to FIGS. 1-10, an article of footwear 10 is provided and includes an upper 12 and a sole structure 14 attached to the upper 12. The article of footwear 10 may be divided into one or more regions. The regions may include a forefoot region 16, a mid-foot region 18, and a heel region 20. The forefoot region 16 may correspond with toes and joints connecting metatarsal bones with phalanx bones of a foot. The mid-foot region 18 may correspond with an arch area of the foot while the heel region 20 may correspond with rear portions of the foot, including a calcaneus bone. The article of footwear 10 may additionally include a medial side 22 and a lateral side 24 that correspond with opposite sides of the article of footwear 10 and extend through the regions 16, 18, 20.

The upper 12 includes interior surfaces that define an interior void 26 that receives and secures a foot for support on the sole structure 14. An ankle opening 28 in the heel region 20 may provide access to the interior void 26. For example, the ankle opening 28 may receive a foot to secure the foot within the void 26 and facilitate entry and removal of the foot from and to the interior void 26. In some examples, one or more fasteners 30 extend along the upper 12 to adjust a fit of the interior void 26 around the foot while concurrently accommodating entry and removal of the foot therefrom. The upper 12 may include apertures 32 such as eyelets and/or other engagement features such as fabric or mesh loops that receive the fasteners 30. The fasteners 30 may include laces, straps, cords, hook-and-loop, or any other suitable type of fastener.

The upper 12 may additionally include a tongue portion 34 that extends between the interior void 26 and the fasteners 30. The upper 12 may be formed from one or more materials that are stitched or adhesively bonded together to form the interior void 26. Suitable materials of the upper 12 may include, textiles, foam, leather, and synthetic leather. The materials may be selected and located to impart properties of durability, air-permeability, wear-resistance, flexibility, and comfort to the foot while disposed within the interior void 26.

The sole structure 14 is attached to the upper 12 and provides the article of footwear 10 with support and cushioning during use. Namely, the sole structure 14 attenuates ground-reaction forces caused by the article of footwear 10 striking the ground during use. Accordingly, and as set forth below, the sole structure 14 may incorporate one or more materials having energy absorbing characteristics to allow the sole structure 14 to minimize the impact experienced by a user when wearing the article of footwear 10.

The sole structure 14 may include a midsole 36, an outsole 38, a plate 40, and one or more cushions 42 that cooperate with the plate 40 and the midsole 36 to provide the sole structure 14 with support and cushioning during use.

With continued reference to FIGS. 1-10, the midsole 36 is shown as including an upper midsole portion 44, a lower, heel midsole portion 46, and a lower, forefoot midsole portion 48. The upper midsole portion 44 extends from an anterior end 50 of the sole structure 14 to a posterior end 52 of the sole structure 14. Namely, the upper midsole portion 44 extends continuously from the anterior end 50 to the posterior end 52 and between a medial side 54 of the sole structure 14 and a lateral side 56 of the sole structure 14. The lower, heel midsole portion 46 and the lower, forefoot midsole portion 48 are discrete elements that are separate from one another and from the upper midsole portion 44. The lower, heel midsole portion 46 is disposed in the heel region 20 and extends from the heel region 20 to the mid-foot region 18. The lower, forefoot midsole portion 48 is disposed in the forefoot region 16 and extends from an area proximate to the anterior end 50 in a direction toward the heel region 20. The midsole 36—including the upper midsole portion 44, the lower, heel midsole portion 44, and the lower, forefoot midsole portion 48—may be formed from a material such as, for example, polymer foam. In one configuration, the midsole 36 opposes a strobel 58 of the upper 12 and may extend at least partially onto an upper surface 60 of the upper 12 (FIG. 1) such that the midsole 36 covers a junction of the upper 12 and the strobel 58.

Forming the midsole 36 from a compliant, yet resilient material such as polymer foam allows the midsole 36 to attenuate ground-reaction forces caused by movement of the article of footwear 10 over ground during use. In addition to attenuating forces associated with use of the article of footwear 10, the midsole 36 may serve to attach the plate 40 to the upper 12. A suitable adhesive (not shown) may be used to attach the midsole 36 and the strobel 58. Alternatively, the plate 40 may be attached to the midsole 36 by molding a material of the midsole 36 directly to the plate 40. For example, the plate 40 may be disposed within a cavity of a mold (not shown) used to form the midsole 36. Accordingly, when the midsole 36 is formed (i.e., by foaming a polymer material), the material of the midsole 36 is joined to the material of the plate 40, thereby forming a unitary structure having both the midsole 36 and the plate 40. Once formed, the midsole 36—including the plate 40—can be attached to the strobel 58 and/or the upper 12.

As described above, the midsole 36 is formed of a resilient polymeric material, such as foam or rubber, to impart properties of cushioning, responsiveness, and energy distribution to the foot of the wearer. Example resilient polymeric materials for the midsole 36 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, ethylene-vinyl alcohol (EVOH) copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed below for barrier elements of the cushions 42. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 6:
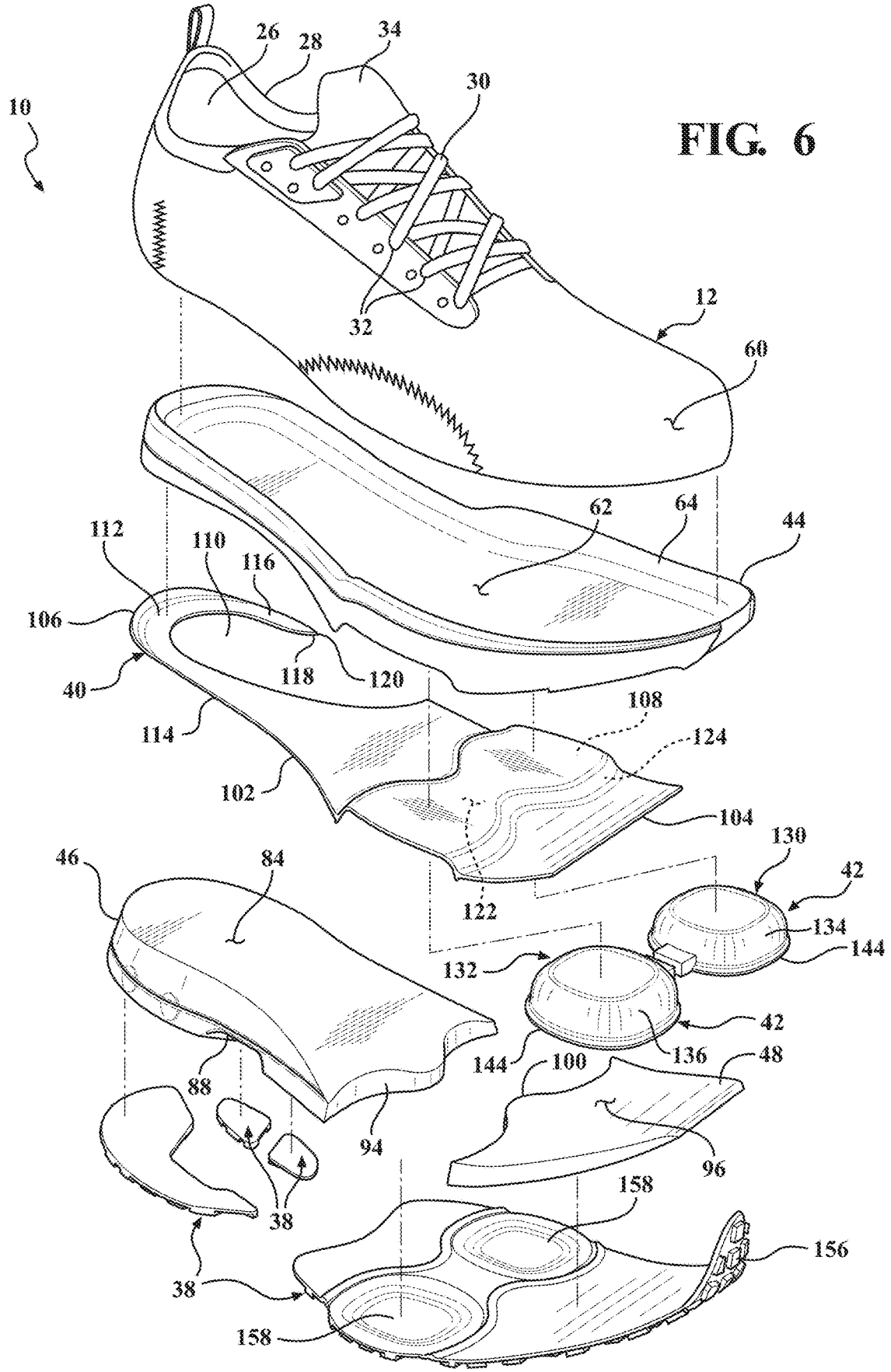
FIG. 6 is a top exploded view of the article of footwear of FIG. 1.
Figure 7:
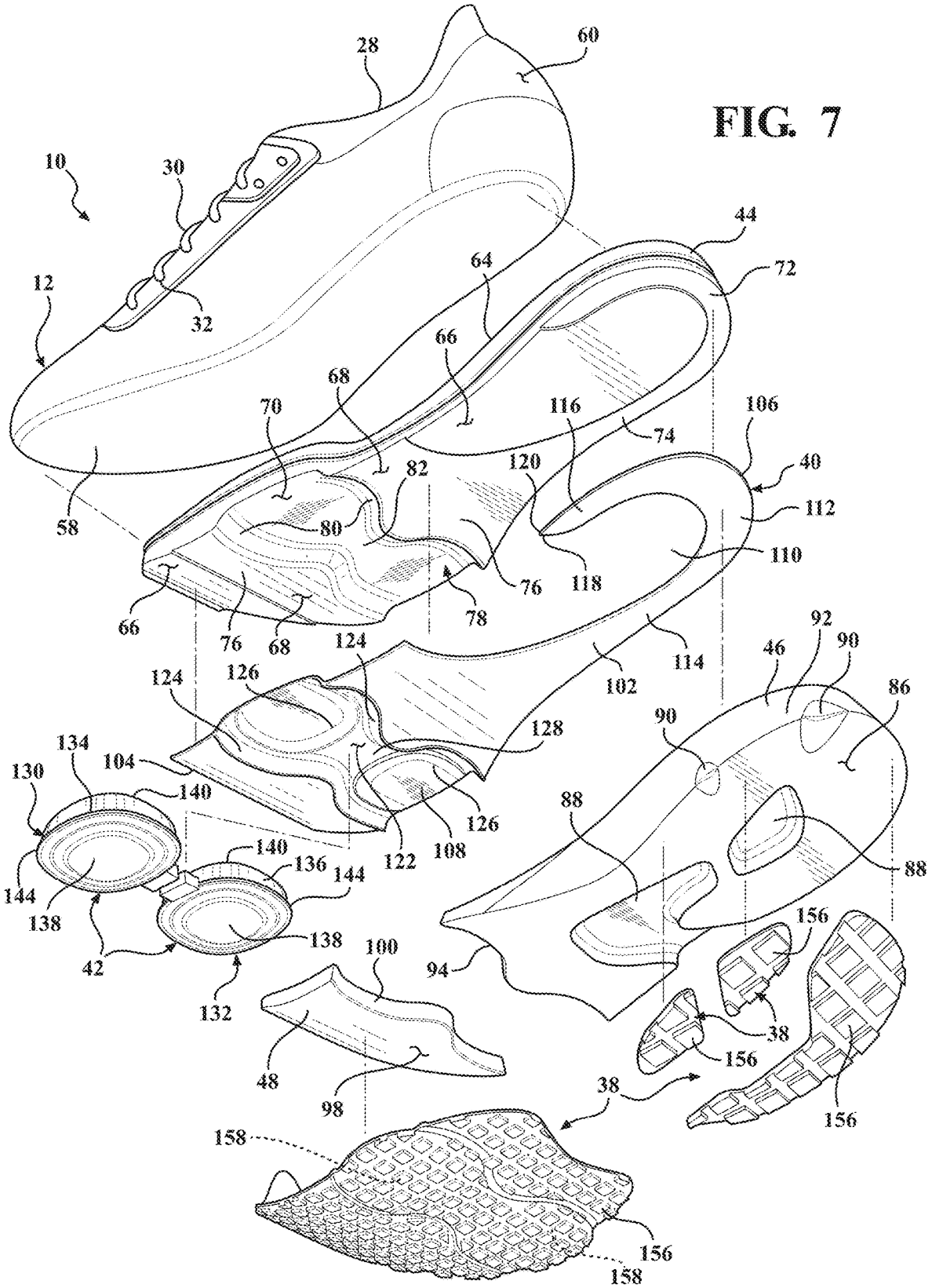
FIG. 7 is a bottom exploded view of the article of footwear of FIG. 1.

While the various components of the midsole 36 may be formed from different materials and by different processes than one another, the upper midsole portion 44, the lower, heel midsole portion 46, and the lower, forefoot midsole portion 48 will be described as being formed from the same polymer foam material. With particular reference to FIGS. 6 and 7, the upper midsole portion 44 is shown as extending along an entire length and width of the sole structure 14 between the anterior end 50 and the posterior end 52 and between the medial side 54 and the lateral side 56. As such, the upper midsole portion 44 extends substantially uninterrupted between the anterior end 50 and the posterior end 52 and between the medial side 54 and the lateral side 56.

The upper midsole portion 44 includes an upper surface 62 that opposes the strobel 58 as well a peripheral lip 64 extending substantially continuously around an outer perimeter of the upper midsole portion 44. As shown in FIG. 1, the peripheral lip 64 extends in a direction toward the upper 12 and extends onto a portion of the upper surface 60 of the upper 12. In so doing, the peripheral lip 64 covers a junction of the upper 12 and the strobel 58 once the sole structure 14 is attached to the upper 12.

The upper midsole portion 44 additionally includes a bottom surface 66, a first recessed surface 68, and a second recessed surface 70 all disposed on an opposite side of the upper midsole portion 44 then the upper surface 62. As shown in FIG. 7, the first recessed surface 68 and the second recessed surface 70 are offset from the bottom surface 66 in a direction toward the upper 12. The first recessed surface 68 includes an arcuate portion 72 disposed proximate to a heel region of the upper midsole portion 44 and extending from the medial side 54 of the sole structure 14 to the lateral side 56 of the sole structure 14, as shown in FIG. 7. The arcuate portion 72 extends from the heel region of the upper midsole portion 44 to a lateral portion 74 of the first recessed surface 68. The lateral portion 74 of the first recessed surface 68 extends from the heel region, along a portion of the lateral side 56 of the sole structure 14 to a main portion 76 of the first recessed surface 68. The main portion 76 of the first recessed surface 68 extends from the mid-foot region 18 to the forefoot region 16 and is interrupted by the second recessed portion 70.

As described, the second recessed surface interrupts the main portion 76 of the first recessed surface 68 such that the main portion 76 is discontinuous in a direction extending from the mid-foot region 18 to the forefoot region 16.

The second recessed surface 70 is disposed within a recess 78 that is offset from the first recessed surface 68 at the main portion 76 in a direction toward the upper 12. As such, the second recessed surface 70 is disposed closer to the upper 12 than the first recessed surface 68. The recess 78 includes a depth measured from the main portion 76 of the first recessed surface 68 to the second recessed surface 70 disposed within the recess 78. A pair of arcuate sidewalls 80 extend from the main portion 76 of the first recessed surface 68 to the second recessed surface 70. The arcuate sidewalls 80 oppose one another across a width of the recess 78 measured in a direction substantially parallel to a longitudinal axis of the upper midsole portion 44. Each of the arcuate sidewalls 80 taper in a direction extending from the first recessed surface 68 to the second recessed surface 70. Further, each arcuate sidewall 80 extends continuously and uninterrupted from the medial side 54 to the lateral side 56 and each includes a non-linear shape. For example, and as best shown in FIG. 7, each of the arcuate sidewalls 80 includes a serpentine shape extending from a first end disposed at the medial side 54 of the sole structure 14 to the lateral side 56 of the sole structure 14. As shown, the recess 78 includes a greater width proximate to the medial side 54 and the lateral side 56 than a central portion of the recess 78 disposed generally proximate to a midpoint of the upper midsole portion 44. Specifically, the serpentine shape of the arcuate sidewalls 80 creates an area of reduced width 82 that is substantially centered between the medial side 54 of the sole structure 14 and the lateral side 56 of the sole structure 14.

The lower, heel midsole portion 46 and the lower, forefoot midsole portion 48 are disposed on an opposite side of the plate 40 than the upper midsole portion 44. The lower, heel midsole portion 46 includes an upper surface 84 and a lower surface 86 disposed on an opposite side of the lower, heel midsole portion 46 than the upper surface 84. The upper surface 84 extends from the posterior end 52 within the heel region 20 of the sole structure 14 in a direction toward the mid-foot region 18. In one configuration, the upper surface 84 extends continuously from the posterior end 52 within the heel region 20 and terminates proximate to a junction of the forefoot region 16 and the mid-foot region 18. The upper surface 84 is substantially flat and opposes the plate 40 once the sole structure 14 is assembled. The substantially flat upper surface 84 of the lower, heel midsole portion 46 is convergent with the lower surface 86 and, as such, provides the lower, heel midsole portion 46 with a thickness that tapers in a direction from the heel region 20 to the forefoot region 16. Accordingly, the lower, heel midsole portion 46 includes a thickness that is greatest proximate to the posterior end 52 and thinnest proximate to the mid-foot region 18.

The lower surface 86 is disposed on an opposite side of the lower, heel midsole portion 46 than the upper surface 84 and opposes the outsole 38. As shown in FIG. 7, the lower surface 86 includes a pair of depressions 88 and a pair of dimples 90. The depressions 88 extend into the lower, heel midsole portion 46 in a direction toward the upper surface 84 and serve to provide the lower, heel midsole portion 46 with localized areas of reduced thickness. Similarly, the dimples 90 extend into a thickness of the lower, heel midsole portion 46 in a direction toward the upper surface 84 and are spaced apart and separated from one another. The dimples 90 are formed at an outer perimeter of the lower, heel midsole portion 46 and extend onto a sidewall 92 of the lower, heel midsole portion 46. The depressions 88 and dimples 90 provide the lower, heel midsole portion 46 with areas of reduced thickness and, thus, allow the lower, midsole portion 46 to more easily bend in these localized areas.

The lower, heel midsole portion 46 additionally includes an arcuate sidewall 94 disposed on an opposite end of the lower, heel midsole portion 46 than the portion of the lower, heel midsole portion 46 disposed proximate to the posterior end 52. The arcuate sidewall 94 extends between the medial side 54 of the sole structure 14 and the lateral side 56 of the sole structure 14 and extends from the upper surface 84 to the lower surface 86.

The arcuate sidewall 94 includes a substantially similar shape as the arcuate sidewall 80 of the recess 78. As such, the arcuate sidewall 94 mimics the arcuate sidewall 80 of the recess 78 such that when the lower, heel midsole portion 46 is positioned relative to the recess 78 of the upper midsole portion 44, the arcuate sidewall 94 of the lower, heel midsole portion 46 is aligned with the arcuate sidewall 80 of the upper midsole portion 44.

The lower, forefoot midsole portion 48 is disposed on an opposite side of the recess 78 than the lower, heel midsole portion 46. As with the lower, heel midsole portion 46, the lower, forefoot midsole portion 48 includes a first surface 96 that opposes the plate 40 and a second surface 98 formed on an opposite side of the lower, forefoot midsole portion 48 than the first surface 96. The lower, forefoot midsole portion 48 tapers in a direction from a portion of the lower, forefoot midsole portion 48 disposed proximate to the recess 78 to a portion of the lower, forefoot midsole portion 48 disposed proximate to the anterior end 50. As such, the lower, forefoot midsole portion 48 increases in thickness in a direction extending from the portion of the lower, forefoot midsole portion 48 disposed proximate to the anterior end 50 to a portion of the lower, forefoot midsole portion 48 disposed closer to the heel region 20. The lower, forefoot midsole portion 48 includes an arcuate sidewall 100 disposed at an opposite end of the lower, forefoot midsole portion 48 than a portion of the lower, forefoot midsole portion 48 disposed proximate to the anterior end 50.

The arcuate sidewall 100 opposes the arcuate sidewall 94 of the lower, heel midsole portion 46 when the lower, forefoot midsole portion 48 is attached to the plate 40. As such, the arcuate sidewall 100 is positioned proximate to the recess 78 and opposes the arcuate sidewall 94 across the recess 78. As will be described in greater detail below, the plate 40 extends across and covers the recess 78 of the upper midsole portion 44 in an area between the arcuate sidewalls 94, 100. However, the arcuate sidewall 94 of the lower, heel midsole portion 46 nonetheless opposes the arcuate sidewall 100 of the lower, midsole portion 48 across the recess 78 of the upper midsole portion 44 when the sole assembly 14 is assembled.

The arcuate sidewall 100 includes a serpentine shape that extends continuously from the medial side 54 of the sole structure 14 to the lateral side 56 of the sole structure 14. The serpentine shape of the arcuate sidewall 100 follows the serpentine shape of the arcuate sidewall 80 of the recess 78 such that the arcuate sidewall 100 of the lower, forefoot midsole portion 48 includes a shape that is similar to the serpentine shape of the arcuate sidewall 80 of the recess 78.

With particular reference to FIGS. 6 and 7, the plate 40 is shown as being disposed between the various elements 44, 46, 48 of the midsole 36 and, as such, provides the midsole 36 with a degree of support and stability. The plate 40 may be formed from a relatively rigid material—a material having a greater rigidity than a material of at least one of the elements 44, 46, 48 of the midsole 36. For example, the plate 40 may be formed from a non-foamed polymer material or, alternatively, from a composite material containing fibers such as carbon fibers. Forming the plate 40 from a relatively rigid material allows the plate 40 to distribute forces associated with use of the article footwear 10 when the article of footwear 10 is in contact with a ground surface, as will be described in greater detail below.

In some examples, the plate 40 includes a uniform local stiffness (e.g., tensile strength or flexural strength) throughout the entire surface area of the plate 40. The stiffness of the plate may be anisotropic where the stiffness in one direction across the plate 40 is different from the stiffness in another direction. For instance, the plate 40 may be formed from at least two layers of fibers anisotropic to one another to impart gradient stiffness and gradient load paths across the plate 40. In one configuration, the plate 40 is formed from one or more layers of tows of fibers and/or layers of fibers including at least one of carbon fibers, aramid fibers, boron fibers, glass fibers, and polymer fibers. In a particular configuration, the fibers include carbon fibers, or glass fibers, or a combination of both carbon fibers and glass fibers. The tows of fibers may be affixed to a substrate. The tows of fibers may be affixed by stitching or using an adhesive. Additionally or alternatively, the tows of fibers and/or layers of fibers may be consolidated with a thermoset polymer and/or a thermoplastic polymer. Accordingly, the plate 40 may have a tensile strength or flexural strength in a transverse direction substantially perpendicular to the longitudinal axis L. The stiffness of the plate 40 may be selected for a particular wearer based on the wearer's shoe size, body mass, running speed, or optimized ankle torque profile. Moreover, the stiffness of the plate 40 may also be tailored based upon a running motion of the athlete. In other configurations, the plate 40 is formed from one or more layers/plies of unidirectional tape. In some examples, each layer in the stack includes a different orientation than the layer disposed underneath. The plate 40 may be formed from unidirectional tape including at least one of carbon fibers, aramid fibers, boron fibers, glass fibers, and polymer fibers. In some examples, the one or more materials forming the plate 40 include a Young's modulus of at least 10a gigapascals (GPa).

In some implementations, the plate 40 includes a substantially uniform thickness ranging from about 0.6 millimeter (mm) to about 5.0 mm. In one example, the thickness of the plate 40 is substantially equal to one 1.0 mm. In other implementations, the thickness of the plate 40 is non-uniform such that the plate 40 may define a greater thickness in different regions of the sole structure 14. The plate 40 may be constructed, as described in U.S. application Ser. No. 15/248,051 and U.S. application Ser. No. 15/248,059, which are hereby incorporated by reference in their entireties.

Regardless of the materials used to form the plate 40, the plate 40 may be a so-called "full-length plate" that extends from the anterior end 50 to the posterior end 52. Allowing the plate 40 to extend from the anterior end 50 to the posterior end 52 causes the plate 40 to extend from the forefoot region 16 through the mid-foot region 18 and to the heel region 20. While the plate 40 may be a full-length plate that extends from the forefoot region 16 to the heel region 20, the plate 40 could alternatively extend through only a portion of the sole structure 14. For example, the plate 40 may extend from the anterior end 50 of the sole structure 14 to the mid-foot region 18 without extending fully through the mid-foot region 18 and into the heel region 20.

With particular reference to FIGS. 6 and 7, the Plate 40 includes a main body 102 extending between a first end 104 and a second end 106. The first end 104 is disposed proximate to the anterior end 50 of the sole structure 14 and the second end 106 is disposed proximate to the posterior end 52 of the sole structure 14. The plate 40 additionally includes a recess 108 disposed along a length of the main body 102, as shown in FIGS. 6 and 7. The recess 108 is formed into the main body 102 in a direction toward the upper 12.

The main body 102 includes a substantially hook-like shape or C-shape at the second end 106. The C-shape of the plate 40 at the second end 106 defines a gap 110 in the Plate 40. In this region, the bottom surface 66 of the upper midsole portion 44 opposes and is secured to the upper surface 84 of the lower, heel midsole portion 46 while the plate 40 itself is received by the recessed surface 68 of the upper midsole portion 44.

In use, the gap 110 serves to locally weaken the plate 40 in the area of the heel region 20, thereby allowing the heel region 20 to more easily flex when subjected to a force such as, for example, during a walking and/or running movement. Namely, the gap 110 serves to effectively remove a portion of the plate 40 in the heel region 20, thereby decreasing the amount of material of the plate 40 at the heel region 20 when compared to the forefoot regions 16 of the plate 40. The reduced material of the plate 40 within the heel region 20 allows the heel region 20 to more easily bend and flex during walking and/or running movements.

The heel region of the plate 40 includes an arcuate portion 112 extending along the heel region at the second end 106 of the plate 40 and between a lateral portion 114 and a medial portion 116. The lateral portion 114 extends continuously from the forefoot region 16, through the mid-foot region 18, and to the heel region 20 where the lateral portion 114 is joined to the arcuate portion 112. The medial portion 116 extends from the arcuate portion 112 in a direction toward the mid-foot region 18 and terminates at a distal end 118. The distal end 118 tapers to a point 120 disposed in an area generally between the heel region 20 and the mid-foot region 18.

As shown in FIGS. 6 and 7, the lateral portion 114 of the plate 40 generally increases in width from the arcuate portion 112 in a direction toward the forefoot region 116. The plate 40 continues to increase in width—as measured in a direction from the lateral side 56 to the medial side 54—until reaching a maximum width at the recess 108. The main body 102 maintains the maximum width in a direction from the medial side 54 to the lateral side 56 at the recess 108 and then tapers from the recess 108 to the first end 104 in a direction toward the anterior end 50.

With particular reference to FIG. 7, the recess 108 is shown as extending continuously from the medial side 54 to the lateral side 56. The recess 108 includes a bottom surface 122 that is offset from the main body 102. Specifically, the bottom surface 122 is offset from the main body 102 in a direction toward the upper 12 such that the bottom surface 122 of the recess 108 is disposed closer to the upper 12 than the main body 102. The bottom surface 122 of the recess 108 likewise extends continuously from the medial side 54 to the lateral side 56 and terminates at the medial side 54 and the lateral side 56.

A pair of arcuate sidewalls 124 extend from the main body 102 of the plate 40 to the bottom surface 122. As such, the arcuate sidewalls 124 cooperate with the bottom surface 122 to generally define the overall shape of the recess 108. As with the arcuate sidewalls 94 of the lower, heel midsole portion 46 and the arcuate sidewalls 100 of the lower, forefoot midsole portion 48, the arcuate sidewalls 124 of the recess 108 each include a substantially serpentine configuration extending continuously from the medial side 54 to the lateral side 56. The serpentine shape of the arcuate sidewalls 124 follows the shape of the arcuate sidewalls 94 of the lower, heel midsole portion 46. As such, the arcuate sidewalls 124 of the recess 108 likewise follow the shape of the arcuate sidewalls 80 of the upper midsole portion 44.

Figure 10:
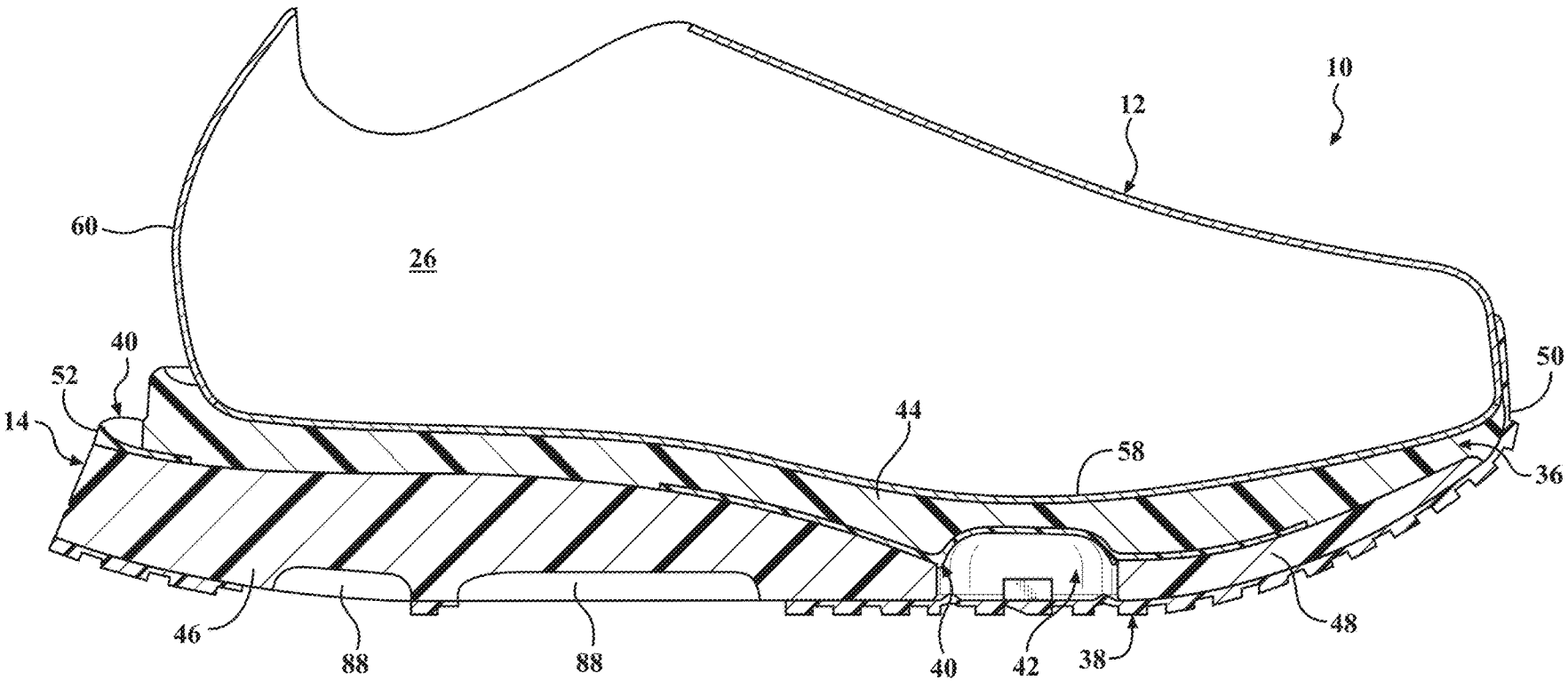
FIG. 10 is a cross-sectional view of the article of footwear of FIG. 1 taken along Line 10-10 of FIG. 5.
Figure 11:
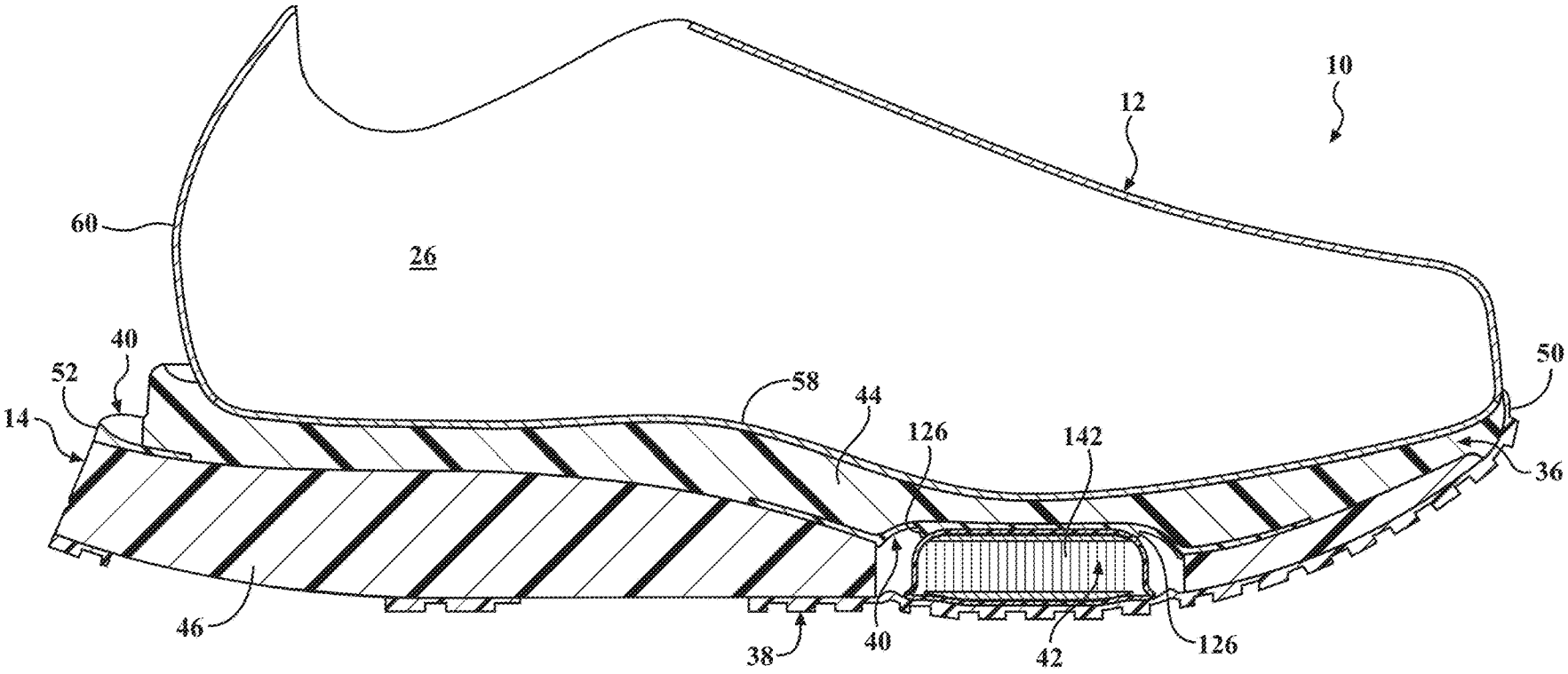
FIG. 11 is a cross-sectional view of the article of footwear of FIG. 1 taken along Line 11-11 of FIG. 5.

The shape of the arcuate sidewalls 124 of the recess 108 and the shape of the bottom surface 122 cooperate to provide the recess 108 with a similar shape as the recess 78 formed in the upper midsole portion 44. Providing the recess 108 of the plate 40 with a similar shape as the recess 78 of the upper midsole portion 44 allows the structure of the plate 40 forming the recess 108 to be matingly received by the recess 78 of the upper midsole portion 44. In so doing, the plate 40 may be in contact with the second recess surface 70 within the recess 78 of the upper midsole portion 44 when the plate 40 is received by the upper midsole portion 44, as best shown in FIGS. 10 and 11.

A pair of retainers 126 extend from the bottom surface 122 within the recess 108 in a direction away from the upper 112. In one configuration, the retainers 126 are flanges that are integrally formed with the plate 40 and have a similar shape to that of the cushions 42. Namely, and as set forth below, the retainers 126 include a shape that is similar to that of the cushions 42 to allow the retainers 126 to matingly engage the cushions 42 and maintain a desired position of the cushions 42 relative to the plate 40. Additionally, the retainers 126 engage the cushions 42 in an effort to control the degree to which the cushions 42 expand when subjected to a force during running and/or walking movements. Specifically, the cushions 42 are separated from one another in a direction extending between the medial side 54 and the lateral side 56 and, as such, are permitted to flex and move toward one another when subject to an applied load. Similarly, the cushions 42 are spaced apart and separated from the sidewalls 124 of the plate 40 and, as such, are likewise permitted to flex and move toward the sidewalls 124 when subjected to an applied load. The retainers 126—by engaging an outer surface of the cushions 42 within the recess 108 and having a higher rigidity than the cushions 42—can help prevent the cushions 42 from moving toward one another and/or toward the sidewalls 124 beyond a predetermined amount. For example, the retainers 126 can engage sidewalls of the cushions 42 to reinforce and support the sidewalls during loading of the cushions 42.

As shown in FIG. 7, the retainers 126 may include a substantially arcuate profile that mimics the substantially arcuate profile of the respective cushions 42. A first one of the retainers 126 is disposed within the recess 108 proximate to the medial side 54 of the sole structure 14 while the other retainer 126 is disposed within the recess 108 proximate to the lateral side 56. The retainers 126 are spaced apart from one another in a direction extending across a width of the sole structure 14 from the medial side 54 to the lateral side 56. Specifically, an area of reduced width 128 of the recess 108 extends between and separates the retainer 126 disposed at the medial side 54 from the retainer 126 disposed at the lateral side. When the plate 40 is attached to the upper midsole portion 44, the area of reduced width 128 of the late 40 is aligned with the area of reduced width 82 of the recess 78 of the upper midsole portion 44.

When the sole structure 14 is assembled, the plate 40 is disposed generally within the midsole 36. Specifically, the plate 40 is disposed between the upper midsole portion 44 and the lower, forefoot midsole portion 48 in the forefoot region 16 of the sole structure 14 and is disposed between the upper midsole portion 44 and the lower, heel midsole portion 46 in the mid-foot region and the heel region 20, as best shown in FIGS. 10 and 11. While the plate 40 is described and shown as being disposed within the midsole 36, a portion of the plate 40 is exposed at a junction of the upper midsole portion 44 and the lower, heel midsole portion 46. Namely, the arcuate portion 112 of the plate 40 extends from the junction of the upper midsole portion 44 and the lower, heel midsole portion 46 at the heel region 20. As such, portions of the arcuate portion 112, the lateral portion 114, and the medial portion 116 of the plate 40 are exposed at the heel region 20. In one configuration, the plate 40 is exposed at a surface of the plate 40 that opposes the upper 12 and, further, is exposed at a surface of the plate 40 that opposes a ground-contacting surface during use of the article of footwear 10.

Exposing the plate 40 at the heel region 20 allows the plate 40 to serve as a doffing ledge to facilitate removal of the article of footwear 10 from a wearer's foot. For example, the exposed plate 40 allows a user to use an extremity such as a hand or foot to engage the plate 40 at the heel region 20 to allow the exposed plate 40 to act as a lever, thereby facilitating removal of the article of footwear 10 from the wearer's foot.

Figure 2:
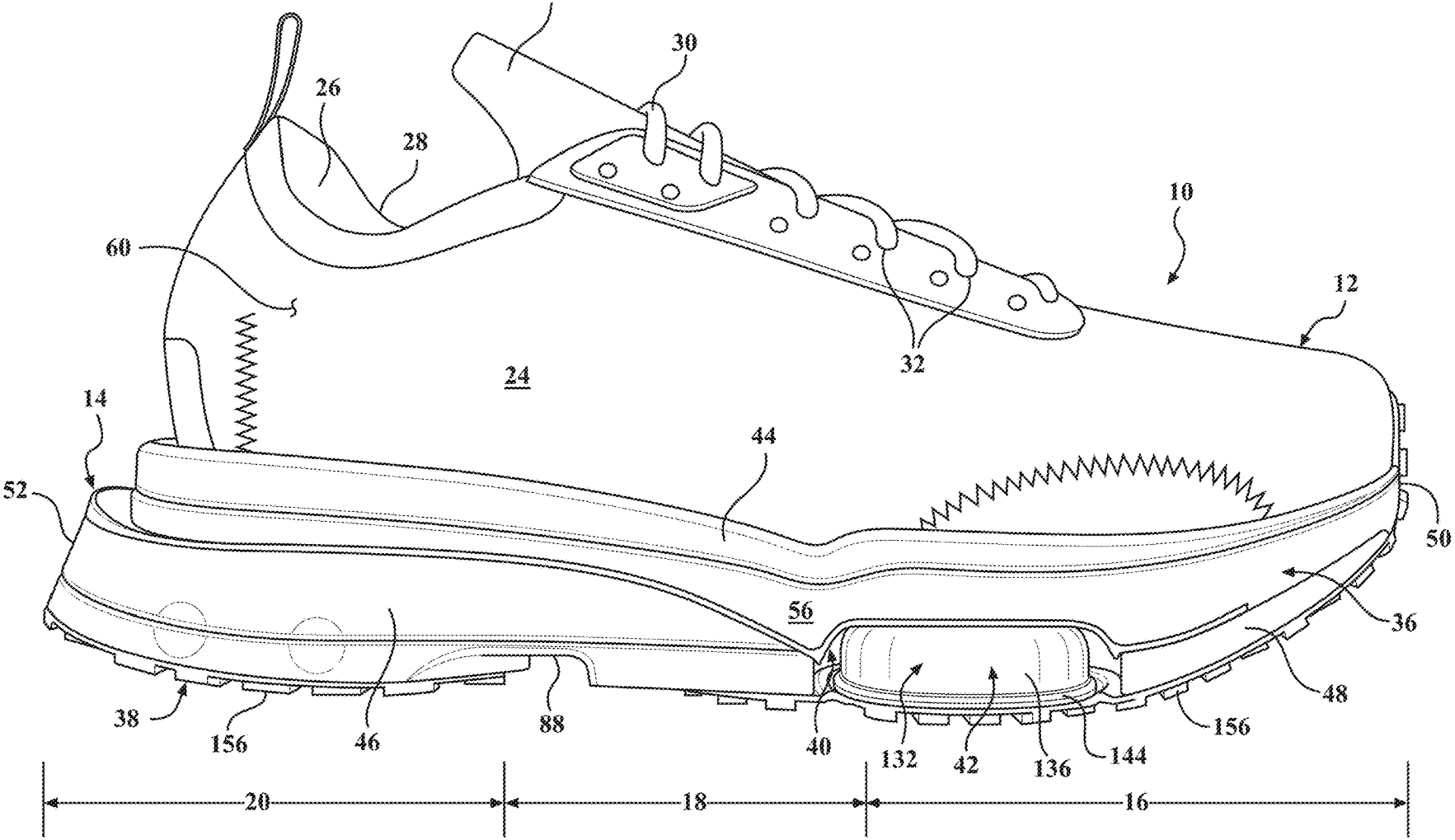
FIG. 2 is a lateral side view of the article of footwear of FIG. 1.
Figure 3:
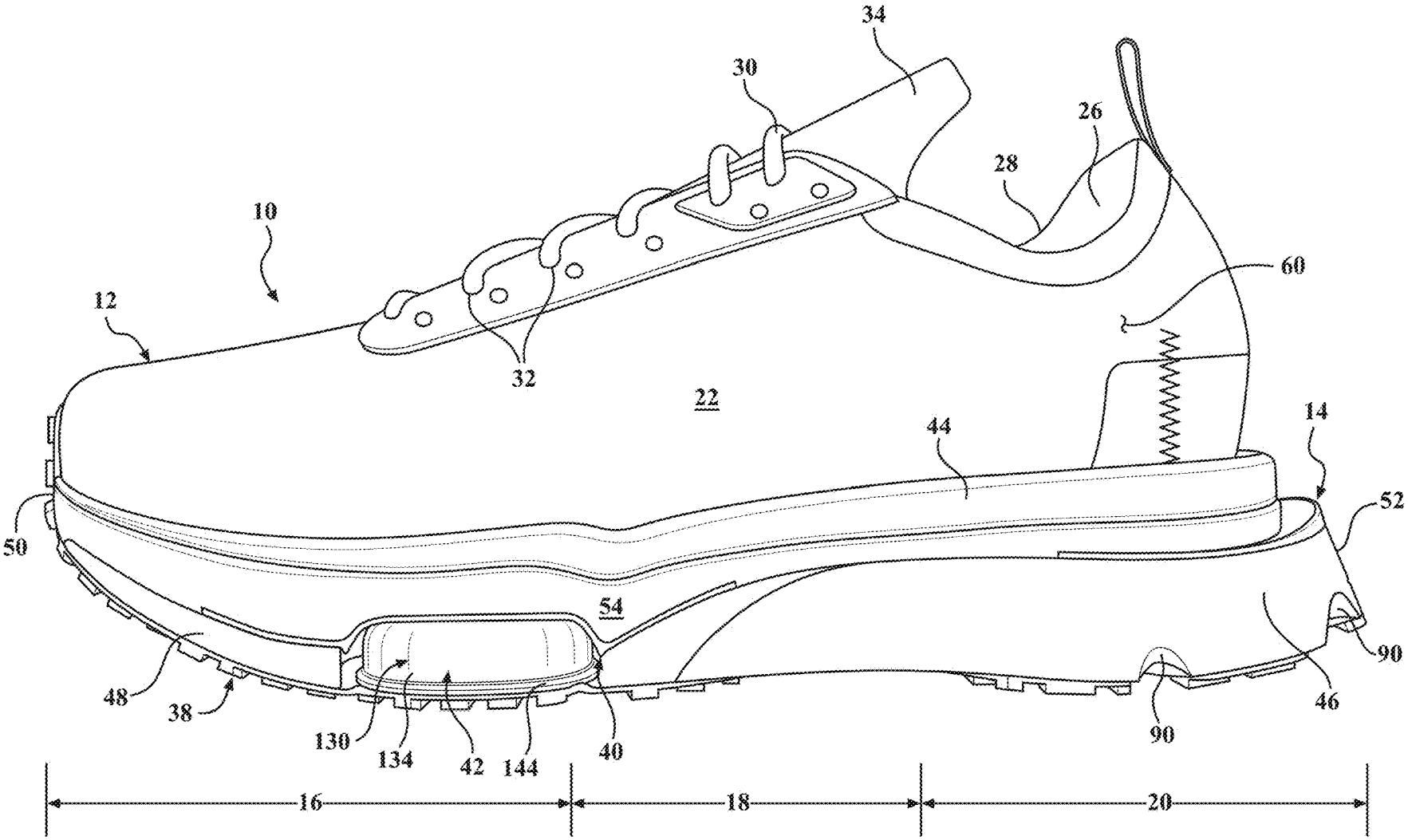
FIG. 3 is a medial side view of the article of footwear of FIG. 1.
Figure 4:
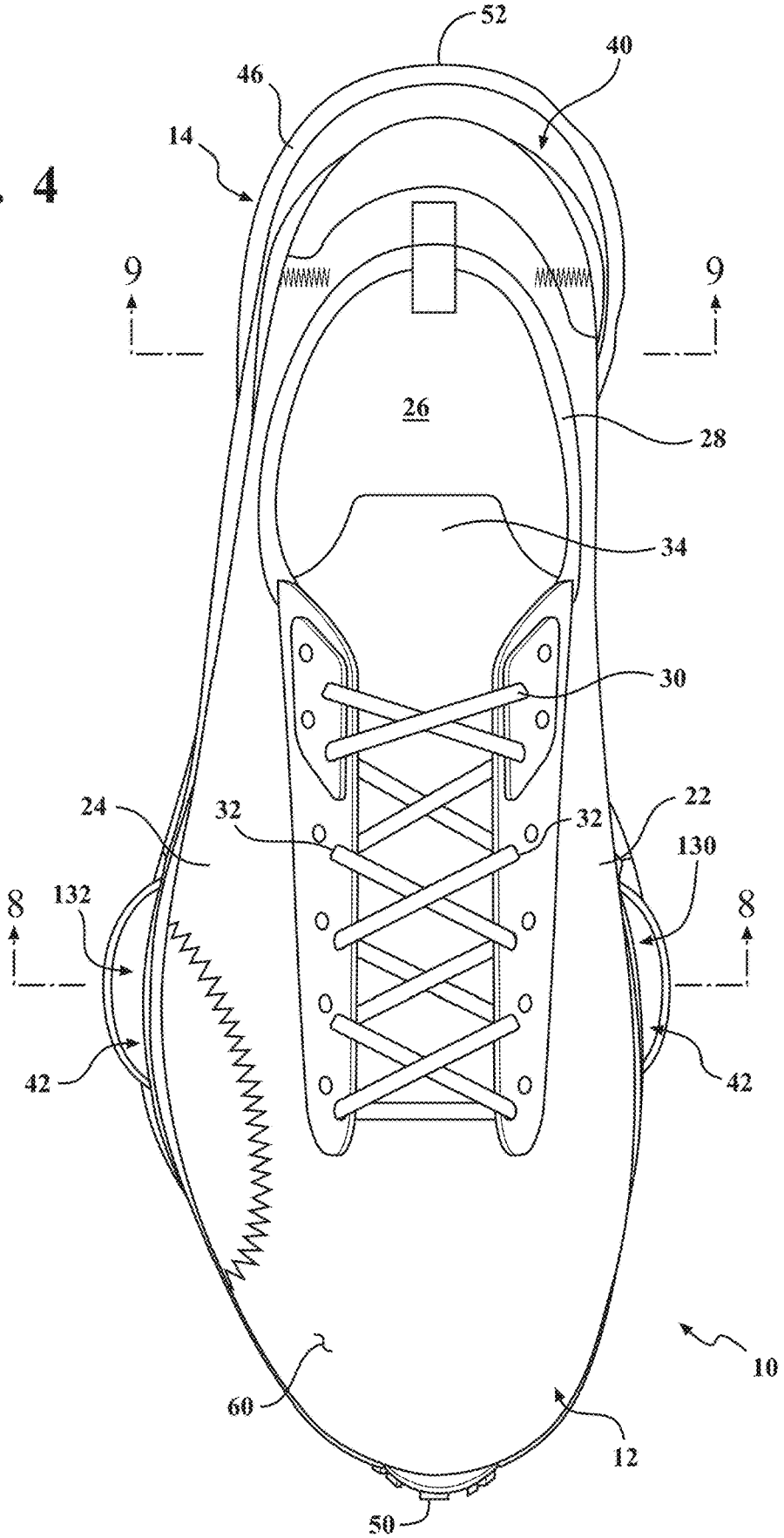
FIG. 4 is a top view of the article of footwear of FIG. 1.
Figure 5:
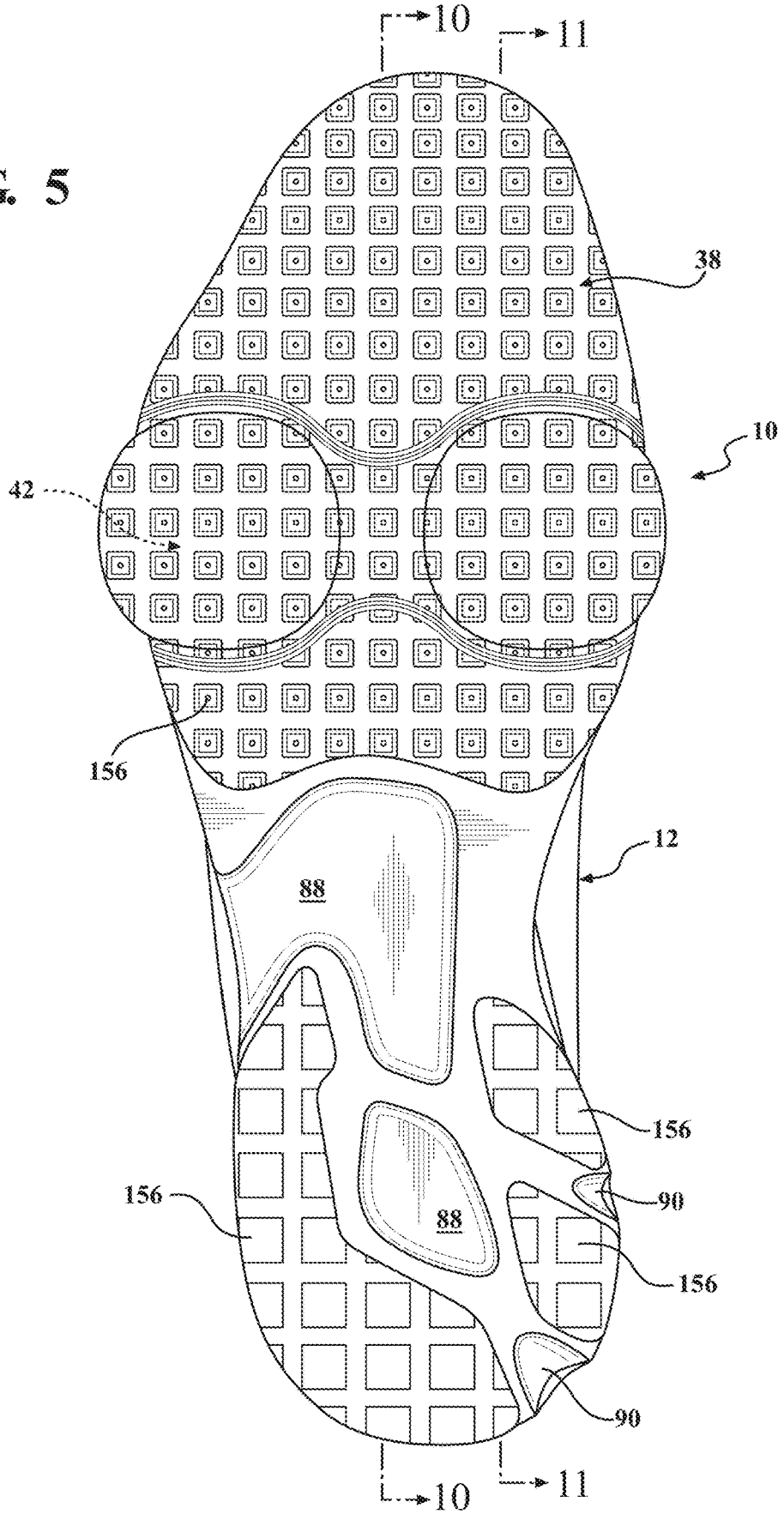
FIG. 5 is a bottom view of the article of footwear of FIG. 1.

With particular reference to FIGS. 1-3, the cushions 42 may include a medial cushion or cushioning arrangement 130 and a lateral cushion or cushioning arrangement 132. The medial cushioning arrangement 130 is disposed proximate to the medial side 54 of the sole structure 14 while the lateral cushioning arrangement 132 is disposed proximate to the lateral side 56 of the sole structure 14. As shown in FIGS. 6 and 7, the medial cushioning arrangement 130 includes a first fluid-filled chamber 134 and the lateral cushioning arrangement 132 likewise includes a second fluid-filled chamber 136. Each of the medial cushioning arrangement 130 and the lateral cushioning arrangement 132 is exposed at the respective medial and lateral sides 54, 56 of the sole structure 14.

The first fluid-filled chamber 134 is disposed generally between the bottom surface 122 of the plate 40 and the outsole 38. Similarly, the second fluid-filled chamber 136 is disposed between the bottom surface 122 of the plate 40 and the outsole 38. As discussed above, the chambers 134, 136 are retained and positioned within the recess 108 by the retainers 126. The chambers 134, 136 may additionally be maintained in a desired position relative to the plate 40 by use of a suitable adhesive and/or by melding a material of the chambers 134, 136 to the plate 40 within the recess 108.

The first fluid-filled chamber 134 and the second fluid-filled chamber 136 may include a first barrier element 138 and a second barrier element 140. The first barrier element 138 and the second barrier element 140 may be formed from a sheet of thermoplastic polyurethane (TPU). Specifically, the first barrier element 138 may be formed from a sheet of TPU material and may include a substantially planar shape. The second barrier element 140 may likewise be formed from a sheet of TPU material and may be formed into the configuration shown in FIG. 7 to define an interior void 142. The first barrier element 138 may be joined to the second barrier element 140 by applying heat and pressure at a perimeter of the first barrier element 138 and the second barrier element 140 to define a peripheral seam 144. The peripheral seam 144 seals the internal interior void 142, thereby defining a volume of the first fluid-filled chamber 134 and the second fluid-filled chamber 136.

Figure 8:
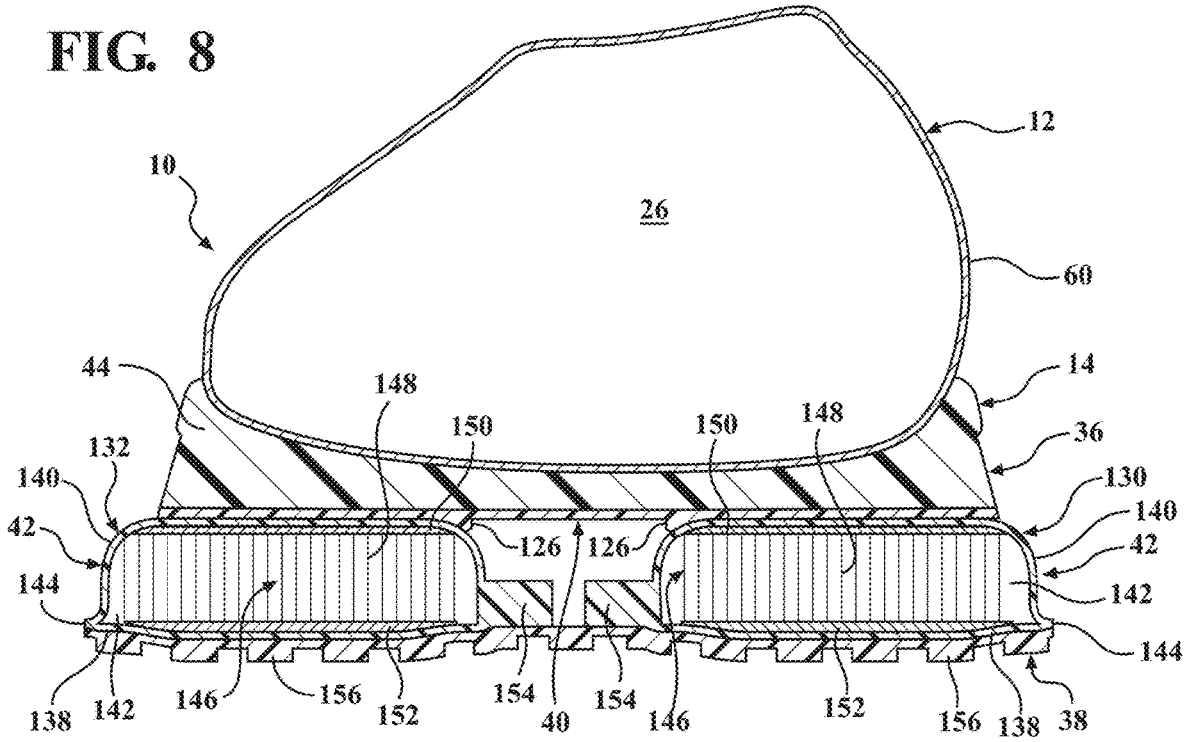
FIG. 8 is a cross-sectional view of the article of footwear of FIG. 1 taken along Line 8-8 of FIG. 4.
Figure 9:
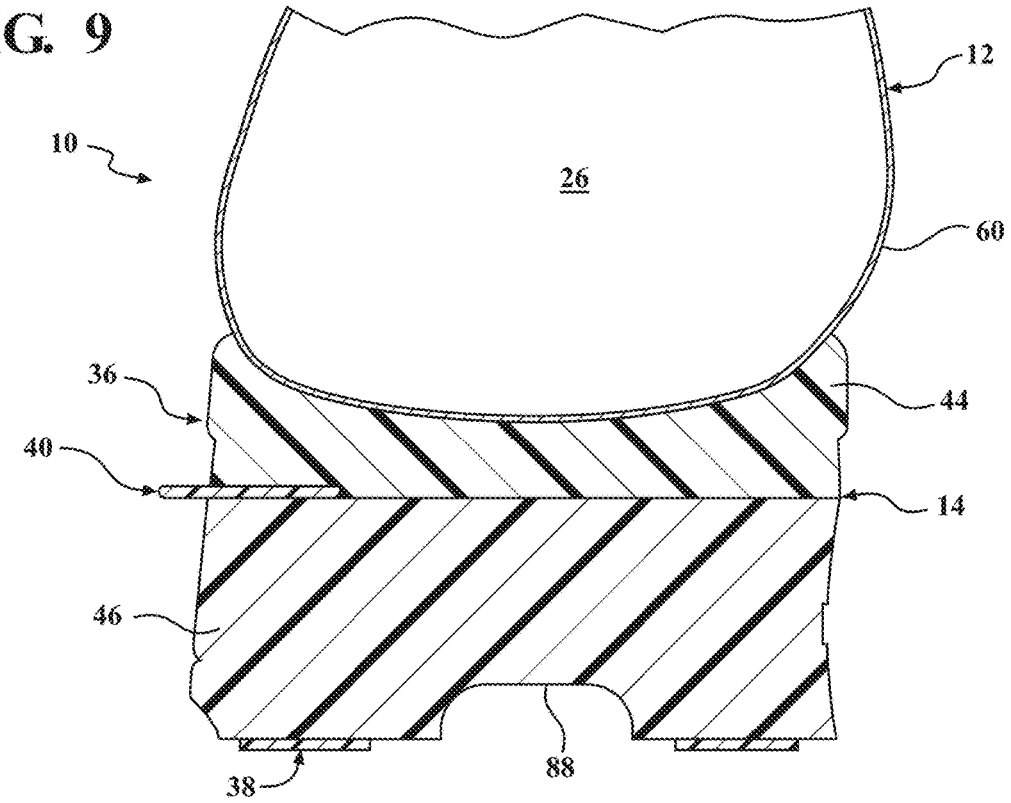
FIG. 9 is a cross-sectional view of the article of footwear of FIG. 1 taken along Line 9-9 of FIG. 4.

The interior void 142 of the first barrier element 138 and the second barrier element 140 may receive a tensile element 146 therein (FIG. 8). Each tensile element 146 may include a series of tensile strands 148 extending between an upper tensile sheet 150 and a lower tensile sheet 152. The upper tensile sheet 150 may be attached to the second barrier element 140 while the lower tensile sheet 152 may be attached to the first barrier element 138. In this manner, when the first fluid-filled chamber 134 and the second fluid-filled chamber 136 receives a pressurized fluid, the tensile strands 148 of the tensile elements 146 are placed in tension. Because the upper tensile sheet 150 is attached to the second barrier element 140 and the lower tensile sheet 152 is attached to the first barrier element 138, the tensile strands 148 retain a desired shape of the first fluid-filled chamber 134 and a desired shape of the second fluid-filled chamber 136 when the pressurized fluid is injected into the interior void 142.

As described, the medial cushioning arrangement 130 and the lateral cushioning arrangement 132 each include a fluid-filled chamber 134, 136, respectively, that are received between the upper 12 and the outsole 38. In one configuration, the first fluid-filled chamber 134 is fluidly isolated from the second fluid-filled chamber 136.

While the medial cushioning arrangement 130 and the lateral cushioning arrangement 132 are described and shown as including fluid-filled chambers, the medial cushioning arrangement 130 and/or the lateral cushioning arrangement 132 could alternatively include other cushioning elements. For example, the medial cushioning arrangement 130 and the lateral cushioning arrangement 132 may each include a foam block (not shown) that replaces the first fluid-filled chamber 134 and/or the second fluid-filled chamber 136. The foam blocks may be received within the interior void 142 defined by the first barrier element 138 and the second barrier element 140. Positioning the foam blocks within the interior void 142 defined by the first barrier element 138 and the second barrier element 140 allows the barrier elements 138, 140 to restrict expansion of the foam blocks beyond a predetermined amount when subjected to a predetermined load. Accordingly, the overall shape and, thus, the performance of the foam blocks may be controlled by allowing the foam blocks to interact with the barrier elements 138, 140 during loading. While the foam blocks are described as being received within the interior void 142 of the barrier elements 138, 140, the foam blocks could alternatively be positioned within the recess 108 at the retainers 126 absent the barrier elements 138, 140. In such a configuration, the foam blocks would be directly attached to the plate 40 within the recess 108 at one end and to the outsole 38 at the other end.

As used herein, the term "barrier element" (e.g., barrier elements 138, 140) encompasses both monolayer and multilayer films. In some embodiments, one or both of barrier elements 138, 140 is produced (e.g., thermoformed or blow molded) from a monolayer film (a single layer). In other embodiments, one or both of barrier elements 138, 140 is produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of barrier elements 138, 140 can independently be transparent, translucent, and/or opaque. For example, the first barrier element 138 may be transparent, while the second barrier element 140 is opaque. As used herein, the term "transparent" for a barrier element and/or a fluid-filled chamber means that light passes through the barrier element in substantially straight lines and a viewer can see through the barrier element. In comparison, for an opaque barrier element, light does not pass through the barrier element and one cannot see clearly through the barrier element at all. A translucent barrier element falls between a transparent barrier element and an opaque barrier element, in that light passes through a translucent element but some of the light is scattered so that a viewer cannot see clearly through the element.

The barrier elements 138, 140 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier elements 138, 140 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier elements 138, 140 include two or more sublayers, examples of suitable multilayer films include microlayer films, such as those disclosed in Bonk et al., U.S. Pat. No. 6,582,786, which is incorporated by reference in its entirety. In further embodiments, barrier elements 138, 140 may each independently include alternating sublayers of one or more TPU copolymer materials and one or more EVOH copolymer materials, where the total number of sublayers in each of barrier elements 138, 140 includes at least four (4) sublayers, at least ten (10) sublayers, at least twenty (20) sublayers, at least forty (40) sublayers, and/or at least sixty (60) sublayers.

The first fluid-filled chamber 134 and/or the second fluid-filled chamber 136 can be produced from the barrier elements 138, 140 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier elements 138, 140 can be produced by co-extrusion followed by vacuum thermoforming to produce an inflatable chamber (i.e., the first fluid-filled chamber 134 and/or the second fluid-filled chamber 136), which can optionally include one or more valves (e.g., one way valves) that allows the first fluid-filled chamber 134 and/or the second fluid-filled chamber 136 to be filled with the fluid (e.g., gas).

The fluid-filled chambers 134, 136 can be provided in a fluid-filled (e.g., as provided in footwear 10) or in an unfilled state. The chambers 134, 136 can be filled to include any suitable fluid, such as a gas or liquid. In an aspect, the gas can include air, nitrogen ($N_2$), or any other suitable gas. In other aspects, the chambers 134, 136 can alternatively include other media, such as pellets, beads, ground recycled material, and the like (e.g., foamed beads and/or rubber beads). The fluid provided to the chambers 134, 136 can result in the chambers 134, 136 being pressurized. Alternatively, the fluid provided to the chambers 134, 136 can be at atmospheric pressure such that the chambers 134, 136 are not pressurized but, rather, simply contain a volume of fluid at atmospheric pressure.

The chambers 134, 136 desirably have a low gas transmission rate to preserve their retained gas pressure. In some embodiments, the chambers 134, 136 have a gas transmission rate for nitrogen gas that is at least about ten (10) times lower than a nitrogen gas transmission rate for a butyl rubber layer of substantially the same dimensions. In an aspect, the chambers 134, 136 have a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier elements 138, 140). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the upper and lower barrier elements 138, 140 are formed by respective mold portions each defining various surfaces for forming depressions and pinched surfaces corresponding to locations where the peripheral seam 144 is formed when the upper barrier element 138 and the lower barrier element 140 are joined and bonded together. In some implementations, adhesive bonding joins the upper barrier element 138 and the lower barrier element 140 to form a web area 154 and the peripheral seam 144. In other implementations, the upper barrier element 138 and the lower barrier element 140 are joined to form the web area 154 and the peripheral seam 144 by thermal bonding. In some examples, one or both of the barrier elements 138, 140 are heated to a temperature that facilitates shaping and melding. In some examples, the barrier elements 138, 140 are heated prior to being located between their respective molds. In other examples, the mold may be heated to raise the temperature of the barrier elements 138, 140. In some implementations, a molding process used to form the fluid-filled chambers 134, 136 incorporates vacuum ports within mold portions to remove air such that the upper and lower barrier elements 138, 140 are drawn into contact with respective mold portions. In other implementations, fluids such as air may be injected into areas between the upper and lower barrier elements 138, 140 such that pressure increases cause the barrier elements 138, 140 to engage with surfaces of their respective mold portions.

With particular reference to FIGS. 6 and 7, the outsole 38 is shown as including various discrete segments that are received by and attached to the midsole 36. Namely, the outsole 38 includes various segments that are attached to portions of the lower, heel midsole portion 46 and the lower, forefoot midsole portion 48 and include traction elements 156 to facilitate gripping a ground surface during use. In one configuration, a forward-most portion of the outsole 38 includes a pair of recesses 158 that respectively receive the cushions 42. The recesses 158 are spaced apart from one another across a width of the outsole 38, are vertically aligned with the retainers 126 of the plate 40, and serve to retain and position the cushions 42 relative to the outsole 38 and, thus, the upper 12. In one configuration, a material of the cushions 42 may be melded to bond the cushions 42 to the outsole 38 within the recesses 158. In other configurations, an adhesive may be used to bond the cushions 42 within the recesses 158 to secure a desired position of the cushions 42 relative to and within the recesses 158. While the outsole 38 is described and shown as including various discrete and individual segments that are respectively attached to the cushions 42, the lower, heel midsole portion 46, and the lower, forefoot midsole portion 48, the outsole 38 could alternatively include a unitary construction having a single number that is attached to the cushions 42, the lower, heel midsole portion 46, and the lower, forefoot midsole portion 48.

In operation, when the sole structure 14 is subjected to a force during running and/or walking movements, the plate 40 provides a degree of strength and stability to the sole structure 14. Further, the plate 40 serves to position the cushions 42 in a desired relationship relative to the upper 12 by positioning the cushions 42 in close proximity to the upper 12. Namely, the portion of the plate 40 formed by the recess 108 is permitted to be moved into close proximity to the upper 12 due to the recess 78 formed in the upper midsole portion 44. Accordingly, when the cushions 42 are received within the recess 108 of the plate 40, the cushions 42 are likewise moved into close proximity to the upper 12 than would otherwise be permitted if the upper midsole portion 44 did not include the recess 78.

Providing the upper midsole portion 44 with the recess 78 and providing the plate 40 with the recess 108 allows the overall height of the sole structure 14 and, thus, the article of footwear 10, to be reduced. As such, the article of footwear can be optimally designed for weight and performance.

During use, when a force is applied to the heel region 20, the plate 40 is permitted to bend and flex due to the generally C-shape of the plate 40 within the heel region 20. As the force transfers from a heel strike and the foot rolls towards the mid-foot region 18 and the forefoot region 16, the force associated with such movement causes the cushions 42 to absorb the forces and expand outward. The retainers 126 maintain a desired position of the cushions 42 relative to the plate 40 and restrict deformation of the cushions 42 beyond a predetermined amount. As the force is continued to be applied to the plate 40, the plate 40 continues to flex as the foot rolls from the heel region 20 to the forefoot region 16. The forces applied to the cushions 42 are transmitted to the plate 40 but are not felt as point loads by the wearer due to the generally rigid nature of the plate 40. Namely, the generally rigid material of the plate 40 dissipates the forces exerted on the plate 40 by the cushions 42 over a substantial length and width of the plate 40 within the mid-foot region 18 and the forefoot region 16. In so doing, the plate 40—in cooperation with the upper midsole portion 44—prevents a point load from being perceived by the wearer during use of the article of footwear 10.

The following Clauses provide exemplary configurations for a sole structure for an article of footwear described above.

Clause 1: A sole structure for an article of footwear having an upper, the sole structure comprising an outsole defining a ground-contacting surface, a midsole disposed between the outsole and the upper, a plate attached to the midsole and defining a recess extending in a direction away from the outsole and toward the upper, the recess including a first retainer, and a first cushion having a first portion received within the recess, the first portion engaging the first retainer to maintain a desired position of the first cushion relative to the plate.

Clause 2: The sole structure of Clause 1, wherein the first cushion has a second portion extending from the recess in a direction toward the outsole.

Clause 3: The sole structure of any of the preceding Clauses, wherein the recess extends from a medial side of the sole structure to a lateral side of the sole structure.

Clause 4: The sole structure of Clause 3, wherein the first retainer is disposed closer to one of the medial side and the lateral side than the other of the medial side and the lateral side.

Clause 5: The sole structure of any of the preceding Clauses, further comprising a second retainer disposed within the recess.

Clause 6: The sole structure of Clause 5, wherein the first retainer is disposed adjacent to one of a medial side of the sole structure and a lateral side of the sole structure and the second retainer is disposed adjacent to the other of the medial side and the lateral side.

Clause 7: The sole structure of Clause 6, wherein the first retainer and the second retainer are aligned with one another across a width of the sole structure.

Clause 8: The sole structure of Clause 5, further comprising a second cushion having a first portion received within the recess, the first portion of the second cushion engaging the second retainer to maintain a desired position of the second cushion relative to the plate.

Clause 9: The sole structure of Clause 8, wherein at least one of the first cushion and the second cushion is a fluid-filled chamber.

Clause 10: The sole structure of any of the preceding Clauses, wherein the first retainer is a flange integrally formed with the plate, the first retainer extending from a surface of the plate within the recess and in a direction toward the outsole.

Clause 11: A sole structure for an article of footwear having an upper, the sole structure comprising an outsole defining a ground-contacting surface, a midsole disposed between the outsole and the upper, a plate attached to the midsole and including a first retainer, the first retainer extending from a first surface of the plate in a direction toward the outsole, and a first cushion opposing the first surface of the plate and engaging the first retainer to maintain a desired position of the first cushion relative to the plate.

Clause 12: The sole structure of Clause 11, wherein the plate includes a main surface, the first surface being offset from the main surface in a direction toward the upper to define a recess.

Clause 13: The sole structure of Clause 12, wherein the recess extends from a medial side of the sole structure to a lateral side of the sole structure.

Clause 14: The sole structure of Clause 13, wherein the first retainer is disposed closer to one of the medial side and the lateral side than the other of the medial side and the lateral side.

Clause 15: The sole structure of any of the preceding Clauses, further comprising a second retainer extending from the first surface of the plate in a direction toward the outsole.

Clause 16: The sole structure of Clause 15, wherein the first retainer is disposed adjacent to one of a medial side of the sole structure and a lateral side of the sole structure and the second retainer is disposed adjacent to the other of the medial side and the lateral side.

Clause 17: The sole structure of Clause 16, wherein the first retainer and the second retainer are aligned with one another across a width of the sole structure.

Clause 18: The sole structure of Clause 15, further comprising a second cushion opposing the first surface of the plate and engaging the second retainer to maintain a desired position of the second cushion relative to the plate.

Clause 19: The sole structure of Clause 18, wherein at least one of the first cushion and the second cushion is a fluid-filled chamber.

Clause 20: The sole structure of any of the preceding Clauses, wherein the first retainer is a flange integrally formed with the plate.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a midsole;

a plate attached to the midsole and including a recess opposing a ground engaging surface and extending continuously from a medial side edge of the sole structure to a lateral side edge of the sole structure and in a direction toward the upper and a substantially C-shape in a heel region of the sole structure, the C-shape including a first portion extending along one of a medial side of the plate and a lateral side of the plate, a second portion extending along the other of the medial side of the plate and the lateral side of the plate, an arcuate portion extending between and connecting the first portion and the second portion, a gap in the heel region, and an opening of the gap disposed at the other of the medial side of the plate and the lateral side of the plate; and a first cushion having a first portion attached to the plate in a first region disposed between the heel region and an anterior end of the sole structure.

2. The sole structure of claim 1, wherein the first portion of the C-shape extends along the lateral side of the plate and the second portion of the C-shape extends along the medial side of the plate, the opening being disposed at a distal end of the second portion.

3. The sole structure of claim 2, wherein the gap is disposed between the first portion of the C-shape and the second portion of the C-shape within the heel region of the plate.

4. The sole structure of claim 1, wherein the plate includes a first surface in contact with the midsole and a second surface disposed on an opposite side of the plate than the first surface, the second surface defining a first retainer.

5. The sole structure of claim 4, wherein the first retainer is disposed adjacent to one of a medial side of the sole structure and a lateral side of the sole structure and receives the first cushion therein.

6. The sole structure of claim 5, wherein the second surface defines a second retainer disposed adjacent to the other of the medial side of the sole structure and the lateral side of the sole structure.

7. The sole structure of claim 6, further comprising a second cushion received by the second retainer.

8. The sole structure of claim 7, wherein at least one of the first cushion and the second cushion is a fluid-filled chamber.

9. An article of footwear incorporating the sole structure of claim 1.

10. A sole structure for an article of footwear having an upper, the sole structure comprising:

a midsole;

a plate attached to the midsole and including a first portion extending along one of a medial side of the plate and a lateral side of the plate, a second portion extending along the other of the medial side of the plate and the lateral side of the plate, an arcuate portion disposed in a heel region of the plate and extending between and connecting the first portion and the second portion, a gap disposed in the heel region and having an opening of the gap disposed at the other of the medial side of the plate and the lateral side of the plate with one of the first portion and the second portion having a distal end that opposes the opening, and a recess opposing a ground engaging surface and extending continuously from a medial side edge of the sole structure to a lateral side edge of the sole structure and in a direction toward the upper; and a first cushion having a first portion attached to the plate in a first region disposed between the heel region and an anterior end of the sole structure.

11. The sole structure of claim 10, wherein the first portion of the plate extends along the lateral side of the plate and the second portion of the plate extends along the medial side of the plate, the distal end being disposed at a terminal end of the second portion.

12. The sole structure of claim 11, wherein the gap is disposed between the first portion of the plate and the second portion of the plate within the heel region of the plate.

13. The sole structure of claim 10, wherein the plate includes a first surface in contact with the midsole and a second surface disposed on an opposite side of the plate than the first surface, the second surface defining a first retainer.

14. The sole structure of claim 13, wherein the first retainer is disposed adjacent to one of a medial side of the sole structure and a lateral side of the sole structure and receives the first cushion therein.

15. The sole structure of claim 14, wherein the second surface defines a second retainer disposed adjacent to the other of the medial side of the sole structure and the lateral side of the sole structure.

16. The sole structure of claim 15, further comprising a second cushion received by the second retainer.

17. The sole structure of claim 16, wherein at least one of the first cushion and the second cushion is a fluid-filled chamber.

18. An article of footwear incorporating the sole structure of claim 10.

* * * * *